US007156953B2

(12) United States Patent
Tirimacco et al.

(10) Patent No.: US 7,156,953 B2
(45) Date of Patent: Jan. 2, 2007

(54) PROCESS FOR PRODUCING A PAPER WIPING PRODUCT

(75) Inventors: Maurizio Tirimacco, Appleton, WI (US); Mark Burazin, Oshkosh, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/382,222

(22) Filed: Mar. 5, 2003

(65) Prior Publication Data

US 2004/0118544 A1 Jun. 24, 2004

Related U.S. Application Data

(63) Continuation-in-part of application No. 10/326,915, filed on Dec. 20, 2002, now abandoned.

(51) Int. Cl.
*D21F 11/00* (2006.01)
*B31F 1/12* (2006.01)

(52) U.S. Cl. ..... 162/112; 162/204; 162/125; 162/127; 162/142; 162/146; 162/157.1; 162/137; 162/135; 428/153; 428/340; 156/291; 156/183

(58) Field of Classification Search ..... 162/193, 162/111–113, 117.1, 23, 125, 127, 129, 135, 162/109, 158, 179, 204, 137; 428/195.1, 428/156, 341, 153, 340; 156/183, 291, 330; 427/361, 391

See application file for complete search history.

(56) References Cited

U.S. PATENT DOCUMENTS

| | | | | | |
|---|---|---|---|---|---|
| 3,879,257 | A | | 4/1975 | Gentile et al. | |
| 4,072,557 | A | * | 2/1978 | Schiel | 162/111 |
| 4,340,563 | A | | 7/1982 | Appel et al. | |
| 4,440,597 | A | * | 4/1984 | Wells et al. | 162/111 |
| 4,551,199 | A | * | 11/1985 | Weldon | 162/109 |
| 4,849,054 | A | * | 7/1989 | Klowak | 162/109 |
| 5,048,589 | A | * | 9/1991 | Cook et al. | 162/109 |
| 5,129,988 | A | | 7/1992 | Farrington, Jr. | |
| 5,411,636 | A | * | 5/1995 | Hermans et al. | 162/109 |
| 5,429,686 | A | | 7/1995 | Chiu et al. | |
| 5,492,598 | A | * | 2/1996 | Hermans et al. | 162/113 |
| 5,494,554 | A | | 2/1996 | Edwards et al. | |
| 5,529,665 | A | | 6/1996 | Kaun | |
| 5,609,728 | A | * | 3/1997 | Durden | 162/205 |
| 5,656,132 | A | | 8/1997 | Farrington, Jr. et al. | |
| 5,672,248 | A | * | 9/1997 | Wendt et al. | 162/109 |
| 5,830,321 | A | * | 11/1998 | Lindsay et al. | 162/204 |
| 5,888,347 | A | | 3/1999 | Engel et al. | |
| 6,096,169 | A | | 8/2000 | Hermans et al. | |
| 6,120,642 | A | | 9/2000 | Lindsay et al. | |
| 6,129,815 | A | * | 10/2000 | Larson et al. | 162/112 |
| 6,143,135 | A | | 11/2000 | Hada et al. | |
| 6,197,154 | B1 | | 3/2001 | Chen et al. | |
| 6,350,349 | B1 | * | 2/2002 | Hermans et al. | 162/111 |
| 6,361,654 | B1 | * | 3/2002 | Chuang et al. | 162/204 |
| 6,458,246 | B1 | | 10/2002 | Kanitz et al. | |
| 6,500,289 | B1 | * | 12/2002 | Merker et al. | 156/183 |

FOREIGN PATENT DOCUMENTS

| | | |
|---|---|---|
| WO | WO 9934057 A1 | 7/1999 |
| WO | WO 0066835 A1 | 11/2000 |

* cited by examiner

*Primary Examiner*—José A. Fortuna
(74) *Attorney, Agent, or Firm*—Dority & Manning, P.A.

(57) ABSTRACT

A process for producing wiping products and wiping products made by the process are disclosed. According to the present invention, a paper web is treated on both sides with a bonding material. After the bonding material is applied, the web is then subjected to a dry rush transfer process during which the web is conveyed from a first moving conveyor to a second moving conveyor. The second moving conveyor generally has a speed slower than the first moving conveyor causing a shearing force to be exerted on the web. The shearing force decreases the stiffness of the web. In one embodiment, an uncreped throughdried base web is used.

34 Claims, 7 Drawing Sheets

PROCESS FOR PRODUCING A PAPER WIPING PRODUCT

RELATED APPLICATIONS

The present application is a Continuation-In-Part Application of U.S. patent application Ser. No. 10/326,915, filed on Dec. 20, 2002 now abandoned.

BACKGROUND OF THE INVENTION

Absorbent paper products such as paper towels, facial tissues and other similar products are designed to include several important properties. For example, the products should have good bulk, a soft feel and should be highly absorbent. The product should also have good strength even while wet and should resist tearing. Unfortunately, it is very difficult to produce a high strength paper product that is also soft and highly absorbent. Usually, when steps are taken to increase one property of the product, other characteristics of the product are adversely affected. For instance, softness is typically increased by decreasing or reducing fiber bonding within the paper product. Inhibiting or reducing fiber bonding, however, adversely affects the strength of the paper web.

One particular process that has proved to be very successful in producing paper towels and wipers is disclosed in U.S. Pat. No. 3,879,257 to Gentile, et al., which is incorporated by reference to the extent that it is non-contradictory therewith. In Gentile, et al., a process is disclosed in which a bonding material is applied in a fine, spaced apart pattern to one side of a fibrous web. The web is then adhered to a heated creping surface and creped from the surface. A bonding material is applied to the opposite side of the web and the web is similarly creped. The process disclosed in Gentile, et al. produces wiper products having exceptional bulk, outstanding softness and good absorbency. The surface regions of the web also provide excellent strength, abrasion resistance, and wipe-dry properties.

Although the process and products disclosed in Gentile, et al. have provided many advances in the art of making paper wiping products, further improvements in various aspects of paper wiping products remain desired. For instance, the process disclosed in Gentile, et al. can have high energy requirements in producing products, since the creping surfaces are normally heated. Thus, although the products produced by the process disclosed in Gentile, et al. have improved properties, a need exists for a more cost effective way to produce products having similar characteristics.

The products produced in Gentile, et al. are also compressed when applied to the heated creping surfaces. By compressing the paper web, some loss in bulk is experienced. As such, a need also exists for a process for producing paper products having characteristics and properties similar to those disclosed in Gentile et al., without deleterious compressive steps.

SUMMARY OF THE INVENTION

In general, the present invention is directed to a method for producing paper products. The paper products can be, for instance, paper towels, industrial wipers, facial tissues, bath tissues, napkins, and the like. The process includes the steps of providing a paper web containing papermaking fibers. The paper web can have a bulk density of at least 2 cubic centimeters per gram (cc/g). In one aspect of the invention, a first bonding material is applied to a first side of the web in a pre-selected pattern. Optionally, a second bonding material is applied in a pre-selected pattern to the second side of the web.

The base web, optionally treated with the bonding material, is then conveyed from a first moving surface, such as a conveyor, to a second moving surface or conveyor. In particular, the second moving conveyor moves slower than the first moving conveyor causing the base web to shear and decrease in stiffness. For example, the second moving conveyor can be moving at a speed that is at least 10% slower than the first moving conveyor, particularly at least 15% slower than the first moving conveyor and, in one embodiment, is moving at a speed that is at least 20% slower than the first moving conveyor. For instance, the second moving conveyor can be moving at a speed that is from about 10% to about 50% slower than the first moving conveyor.

The paper web that is treated in accordance with the present invention can be made according to different processes. For example, in one embodiment, the web can be an uncreped, through-air dried base sheet. The paper web can have a basis weight of from about 15 grams per square meter (gsm) to about 110 gsm, and particularly from about 35 gsm to about 70 gsm.

The bonding materials that are optionally applied to the base web can be applied in preselected patterns. The patterns applied to each side of the web can be the same or different. For example, the patterns can be reticulated patterns or can be patterns that comprise a succession of discrete shapes.

The first and second bonding materials can be the same materials or can be different bonding materials. In general, the first and second bonding materials can be applied to the first and second sides of the paper web in a combined amount of from about 2% to about 25% by weight of the paper web and particularly from about 4% to about 10% by weight of the web. The bonding materials can cover from about 25% to about 75% of the surface area of each side of the web, and particularly from about 40% to about 60% of the surface of each side of the web.

In one embodiment of the present invention, the paper web can be conveyed from the first moving surface to the second moving surface and subjected to the above-described shear forces without being treated with a bonding material. In this embodiment, the paper web may be partially dried or fully dried. For example, the paper web can have a consistency (solids) of at least 50%, at least 70%, or at least 90%. In one particular embodiment, the paper web can be substantially dry having a consistency of greater than 90%, such as greater than about 94%.

Other features and aspects of the present invention are discussed in greater detail below.

BRIEF DESCRIPTION OF THE DRAWINGS

A full and enabling disclosure of the present invention, including the best mode thereof to one of ordinary skill in the art, is set forth more particularly in the remainder of the specification, including reference to the accompanying figures in which.

Figure 1:
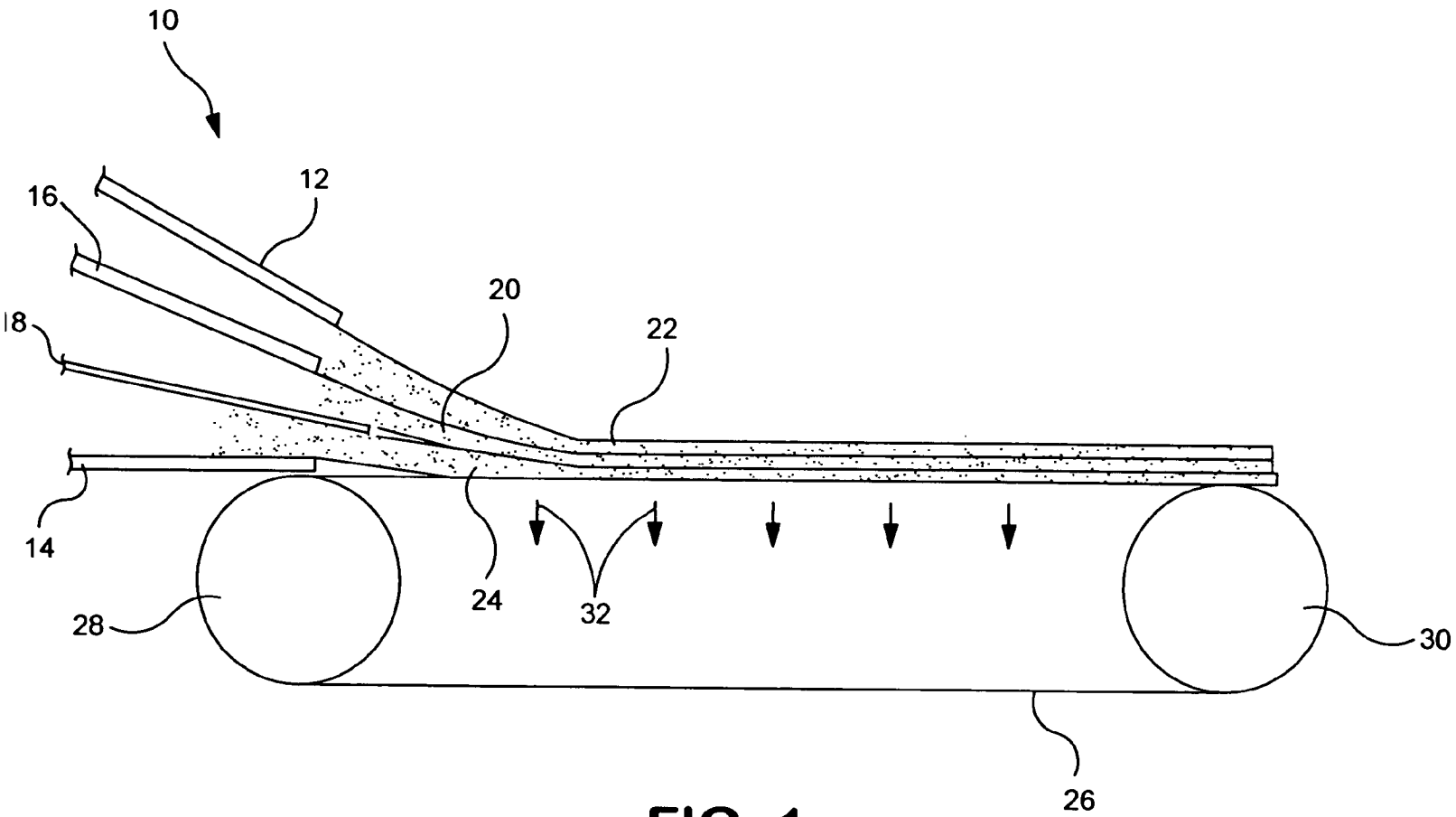
FIG. 1 is a schematic diagram of a paper web forming machine, illustrating the formation of a stratified paper web having multiple layers in accordance with one aspect of the present invention.

Repeat use of reference characters in the present specification and drawings is intended to represent same or analogous features or elements of the present invention.

DETAILED DESCRIPTION

It is to be understood by one of ordinary skill in the art that the present discussion is a description of exemplary embodiments only, and is not intended as limiting the broader aspects of the present invention, which broader aspects are embodied in the exemplary construction.

In general, the present invention is directed to a process for producing paper wiping products having great softness and strength characteristics. In particular, the wiping products have high strength values when either dry or wet. Further, the products have good stretch characteristics and are tear resistant.

In one aspect, the process of the present invention involves subjecting a base web, such as a paper web to a dry "rush transfer" process. As used herein, a rush transfer process generally involves conveying the paper web from a first moving surface to a second moving surface in which there is a speed differential between the moving surfaces. This speed differential causes shearing forces to be exerted on the web. For example, in one embodiment, the second moving surface is positioned downstream from the first moving surface and is operated at a slower speed than the first moving surface.

The moving surfaces used in the rush transfer process may be any suitable web conveying devices. For instance, the web may be supported on conveyors or rotating rolls during the rush transfer process. In another embodiment, the combination of a conveyor and a roll may be used.

Subjecting a low moisture content paper web to a rush transfer process can generate intense shear at the point of contact between the faster moving surface, the base sheet, and the slower moving surface. These shear forces that are generated can at least partially delaminate the base web, lower stiffness and increase softness.

Rush transfer processes have conventionally been performed on paper webs during formation of the webs while the webs were still wet and at low consistency. In the process of the present invention, however, rush transfer is carried out on a lower moisture content paper web. For example, the paper web that is subjected to the dry rush transfer process of the present invention can have a consistency of at least 50%, at least 70%, or at least 80%. In one embodiment, the paper web can be substantially dry having a consistency of greater than about 90%, such as greater than about 94%.

The rush transfer process of the present invention provides various advantages and benefits. For example, the rush transfer process can decrease the stiffness and therefore the perceived softness of the paper web. In other embodiments, it is believed that the process can further maintain increased sheet caliper, increase the roll bulk of the web, increase the machine direction stretch of the web, increase the cross machine direction stretch of the web, in addition to increasing other softness characteristics. Based upon the process parameters, any of the above effects can be isolated and optimized. Further, all of these properties can be improved without subjecting the paper web to any compressive forces. For instance, in order to construct the paper webs in accordance with the present invention, the webs need not be pressed against a creping drum, a dryer drum, calendared, and the like.

In one particular embodiment of the present invention, although optional, a first bonding material can be applied to a first side of the paper web according to a preselected pattern prior to the dry rush transfer process. Also optional, a second bonding material, which can be the same or different from the first bonding material, can be applied according to a preselected pattern to the second side of the web also prior to the rush transfer process. The rush transfer process can occur immediately after the bonding materials are applied to the first and/or the second side of the web, or can occur after the bonding material is dried and/or cured. When a bonding material is present on at least one side of the paper web, shear intensity can be enhanced during the rush transfer process due to the increased traction between the base web and the moving surfaces that is caused by the presence of the bonding material. In this embodiment, the bonding material can also serve to increase the strength of the web.

In another alternative embodiment of the present invention, instead of processing a paper web, other textile materials may be subjected to the rush transfer process of the present invention. For example, any suitable nonwoven or woven web may be processed according to the present invention. Examples of nonwoven webs include webs made from synthetic or natural fibers and can include, for instance, bonded carded webs, spunbond webs, meltblown webs, and coform webs.

As used herein meltblown fibers are fibers of a polymeric material which are generally formed by extruding a molten thermoplastic material through a plurality of fine, usually circular, die capillaries as molten threads or filaments into converging high velocity, usually hot, gas (e.g. air) streams which attenuate the filaments of molten thermoplastic material to reduce their diameter. Thereafter, the meltblown fibers may be carried by the high velocity gas stream and deposited on a collecting surface to form a web of randomly dispersed meltblown fibers. Meltblown fibers may be continuous or discontinuous and are generally tacky when deposited onto a collecting surface.

A spunbond web, on the other hand, refers to a web of nonwoven material formed by spunbond techniques which are conventional in the art. Spunbond materials prepared with continuous filaments generally have at least three common features. First, the polymer is continuously extruded through a spinneret to form discrete filaments. Thereafter, the filaments are drawn either mechanically or pneumatically without breaking in order to molecularly orient the polymer filaments and achieve tenacity. Lastly, the continuous filaments are subsequently deposited in a substantially random manner onto a carrier belt and bonded to form a web. The production of spunbond nonwoven webs is illustrated in U.S. Pat. No. 4,340,563, issued Jul. 20, 1982 to Appel et al., the disclosure of which is incorporated by reference herein as to all relevant matter.

The base web or paper web that is processed according to the present invention can vary depending upon the particular embodiment. For example, when a paper web is utilized, a paper making process of the present invention can utilize adhesive creping, wet creping, double creping, embossing, wet pressing, air pressing, through-air drying, creped through-air drying, uncreped through-air drying, as well as other steps in forming the paper web. In one particular embodiment, for instance, the paper web is not creped during its formation or dried in any manner that requires compression. For instance, in one embodiment, the paper web can be a through-air dried uncreped paper web.

Paper webs processed according to the present invention can also contain various different types of fibers. In general, however, the paper web contains papermaking fibers. Papermaking fibers can include all known cellulosic fibers or fiber mixes comprising cellulosic fibers. Fibers suitable for making base webs of the invention comprise any natural or synthetic cellulosic fibers including, but not limited to, non-woody fibers such as cotton, abaca, kenaf, sabai grass, flax, esparto grass, straw, jute, hemp, bagasse, milkweed floss fibers, and pineapple fibers. Other suitable fibers include woody fibers such as those obtained from deciduous and coniferous trees, including softwood fibers, such as northern and southern softwood kraft fibers. In addition to softwood fibers, hardwood fibers can also be used, such as eucalyptus, maple, birch, and aspen fibers. Woody fibers can be prepared by any known method including Kraft, sulfite, high-yield pulping methods and other known pulping methods. Fibers prepared from organosolv pulping methods can also be used.

A portion of the fiber furnish, such as up to 50 percent (%) or less by dry weight can be synthetic fibers such as polyolefin fibers, polyester fibers, bicomponent sheath-core fibers, multi-component binder fibers and the like. Synthetic cellulose fiber types can also be used including rayon, and other fibers derived from viscose or chemically modified cellulose. Chemically treated natural cellulosic fibers can be used such as mercerized pulps, chemically stiffened or cross-linked fibers, or sulfonated fibers. For example, in one embodiment, synthetic fibers can be present in the fiber furnish in an amount from about 2% to about 30% by dry weight.

Other papermaking fibers that can be used in the present invention include paper broke or recycled fibers, and high yield fibers. As used herein, "high-yield pulp fibers" are those papermaking fibers produced by pulping processes providing a yield of about 65 percent or greater, more specifically about 75 percent or greater, and still more specifically from about 75 to about 95 percent. Yield is the resulting amount of processed fiber expressed as a percentage of the initial wood mass. Such pulping processes include bleached chemithermomechanical pulp (BCTMP), chemithermomechanical pulp (CTMP) pressure/pressure thermomechanical pulp (PTMP), thermomechanical pulp (TMP), thermomechanical chemical pulp (TMCP), high-yield sulfite pulps, and high-yield kraft pulps, all of which leave the resulting fibers with high levels of lignin. High-yield fibers are well known for their stiffness (in both dry and wet states) relative to typical chemically pulped fibers. The cell wall of kraft and other non-high-yield fibers tends to be more flexible because lignin, the "mortar" or "glue" on and in part of the cell wall, has been largely removed. Lignin is also nonswelling in water and hydrophobic, and resists the softening effect of water on the fiber, maintaining the stiffness of the cell wall in wetted high-yield fibers relative to kraft fibers. The preferred high-yield pulp fibers can also be characterized by being comprised of comparatively whole, relatively undamaged fibers, high freeness (250 Canadian Standard Freeness (CSF) or greater, more specifically 350 CSF or greater, and still more specifically 400 CSF or greater), and low fines content (less than 25 percent, more specifically less than 20 percent, still more specifically less that 15 percent, and still more specifically less than 10 percent by the Britt jar test).

Although all of the above-described fibers can be used in the present invention, for many applications, the paper web of the present invention will contain primarily softwood fibers either alone or in conjunction with hardwood fibers.

The paper web of the present invention can also be formed without a substantial amount of inner fiber-to-fiber bond strength. In this regard, the fiber furnish used to form the base web can be treated with a chemical debonding agent. The debonding agent can be added to the fiber slurry during the pulping process or can be added directly into the head box. Suitable debonding agents that may be used in the present invention include cationic debonding agents such as fatty dialkyl quaternary amine salts, mono fatty alkyl tertiary amine salts, primary amine salts, imidazoline quaternary salts, silicone quaternary salt and unsaturated fatty alkyl amine salts. Other suitable debonding agents are disclosed in U.S. Pat. No. 5,529,665 to Kaun which is incorporated herein by reference to the extent that it is non-contradictory therewith. In particular, Kaun discloses the use of cationic silicone compositions as debonding agents.

In one embodiment, the debonding agent used in the process of the present invention is an organic quaternary ammonium chloride and particularly a silicone based amine salt of a quaternary ammonium chloride. For example, the debonding agent can be PROSOFT TQ1003 marketed by the Hercules Corporation of Wilmington, Del. The debonding agent can be added to the fiber slurry in an amount of from about 1 kg per metric tonne to about 6 kg per metric tonne of fibers present within the slurry.

In an alternative embodiment, the debonding agent can be an imidazoline-based agent. The imidazoline-based debonding agent can be obtained, for instance, from the Witco Corporation of Greenwich, Conn. The imidazoline-based debonding agent can be added in an amount of between 2.0 to about 15 kg per metric tonne.

In one embodiment, the debonding agent can be added to the fiber furnish according to a process as disclosed in PCT Application having an International Publication No. WO 99/34057 filed on Dec. 17, 1998, or in PCT Published Application having an International Publication No. WO 00/66835 filed on Apr. 28, 2000, which are both incorporated herein by reference to the extent that they are non-contradictory therewith. In the above publications, a process is disclosed in which a chemical additive, such as a debonding agent, is adsorbed onto cellulosic papermaking fibers at high levels. The process includes the steps of treating a fiber slurry with an excess of the chemical additive, allowing sufficient residence time for adsorption to occur, filtering the slurry to remove unadsorbed chemical additives, and redispursing the filtered pulp with fresh water prior to forming a nonwoven web.

The paper web can also be formed from multiple layers of a fiber furnish. The paper web can be produced, for instance, from a stratified headbox. Layered structures produced by any means known in the art are within the scope of the present invention, including those disclosed in U.S. Pat. No. 5,494,554 to Edwards, et al., which is incorporated herein by reference to the extent that it is non-contradictory therewith.

In one embodiment, for instance, a layered or stratified web is formed that contains at least three layers and has a weak center layer in comparison to the outer layers. As used herein, a weak center layer refers to a layer that has a tensile strength that is lower than the outer layers. By constructing a base web having a weak center layer, more disruption occurs in the web when the web is subjected to the dry rush transfer process of the present invention. In particular, the shear forces that are exerted on the web have a greater impact on the center of the web if the center of the web is weaker than the outer layers. By having a weak center layer, it is believed that the rush transfer process will create greater softness and less stiffness.

Various methods and constructions can be used to produce base webs having a weak center layer in accordance with the present invention. For example, in one embodiment, different fiber types can be incorporated into a middle layer of a stratified base web for creating a weak layer. For example, in one embodiment, a stratified base web can be formed having three layers. The two outer layers can contain primarily softwood fibers. The center layer, on the other hand, can contain hardwood fibers either alone or in combination with softwood fibers. The inclusion of hardwood fibers in the middle layer creates a weak center layer in comparison to the outside layers.

Instead of or in addition to hardwood fibers and/or softwood fibers, the middle layer can also contain synthetic fibers which do not form hydrogen bonds, high-yield fibers, mercerized pulp, and the like. When present in a middle layer, the hardwood fibers, synthetic fibers, high-yield fibers, mercerized pulp, and the like can be present in an amount from about 3% to 100% by weight of the layer, and particularly from about 5% to about 25% by weight of the layer. Each of the above fiber types can produce weak center layers, especially in comparison to outer layers made primarily from softwood fibers.

In one embodiment, each outer layer can comprise from about 15 percent to about 40 percent by weight of the web and particularly can comprise from about 20 percent to about 35 percent by weight of the web. The middle layer, however, can comprise from about 20 percent to about 70 percent by weight of the web, and particularly from about 30 percent to about 60 percent by weight of the web.

In addition to adding particular types of fibers to a middle layer in a stratified web, another method for producing a weak center layer is to add proportionately greater amounts of a debonder to a middle layer in comparison to the outer layers. For example, a stratified fiber furnish can be used to form a web that contains exclusively softwood fibers. A weak center layer, however, can be formed by adding a debonder to the middle layer in amounts greater than the outer layers. For example, the middle layer can contain a debonder in an amount that is at least 10% greater than the amount of debonder added to the outer layers and particularly in an amount that is at least 20% greater than the amount of debonder present in the outer layers.

Referring to FIG. 1, one embodiment of a device for forming a multi-layered stratified pulp furnish is illustrated. As shown, a three-layered head box generally 10 includes an upper head box wall 12 and a lower head box wall 14. Head box 10 further includes a first divider 16 and a second divider 18, which separate three fiber stock layers.

Each of the fiber layers comprise a dilute aqueous suspension of papermaking fibers. In one embodiment, for instance, middle layer 20 contains southern softwood kraft fibers either alone or in combination with other fibers. Outer layers 22 and 24, on the other hand, contain softwood fibers, such as northern softwood kraft.

An endless traveling forming fabric 26, suitably supported and driven by rolls 28 and 30, receives the layered papermaking stock issuing from head box 10. Once retained on fabric 26, the layered fiber suspension passes water through the fabric as shown by the arrows 32. Water removal is achieved by combinations of gravity, centrifugal force and vacuum suction depending on the forming configuration.

Forming multi-layered paper webs is also described and disclosed in U.S. Pat. No. 5,129,988 to Farrington, Jr., which is incorporated herein by reference to the extent that it is non-contradictory therewith.

The basis weight of paper webs used in the process of the present invention can vary depending upon the final product. For example, the process of the present invention can be used to produce tissue products such as paper towels, industrial wipers, and the like. For these products, the basis weight of the paper web can vary from about 15 gsm to about 110 gsm, and particularly from about 35 gsm to about 90 gsm. In one particular embodiment, it has been discovered that the present invention is particularly well-suited for the production of wiping products having a basis weight of from about 53 gsm to about 63 gsm.

As stated above, various different types of paper webs can be used in the process of the present invention. In one particular embodiment, however, the paper web is an uncreped, through-air dried web. It is believed that various advantages and benefits are obtained when using a web, such as an uncreped, through-air dried web, that is produced without being compressed during its drying, such as by using a through-air drier.

Figure 2:
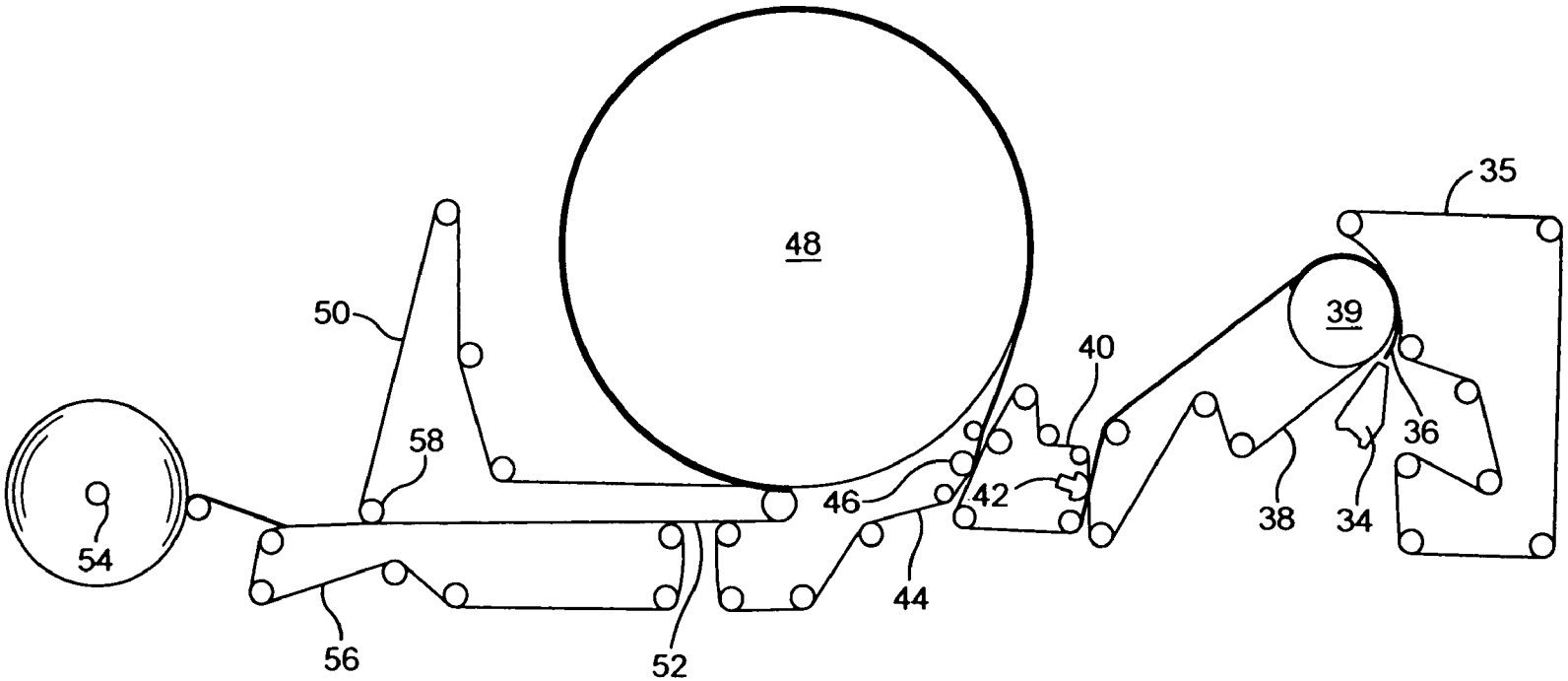
FIG. 2 is a schematic diagram of one embodiment of a process for forming uncreped through-dried paper webs for use in the present invention.

For example, referring to FIG. 2, shown is a method for making throughdried paper sheets in accordance with this invention. (For simplicity, the various tensioning rolls schematically used to define the several fabric runs are shown but not numbered. It will be appreciated that variations from the apparatus and method illustrated in FIG. 2 can be made without departing from the scope of the invention). Shown is a twin wire former having a papermaking headbox 34, such as a layered headbox, which injects or deposits a stream 36 of an aqueous suspension of papermaking fibers in between a forming fabric 38 positioned on a forming roll 39 and a second forming fabric 35. The forming fabric 38 serves to support and carry the newly formed wet web downstream in the process as the web is partially dewatered to a consistency of about 10 dry weight percent. Additional dewatering of the wet web can be carried out, such as by vacuum suction, while the wet web is supported by the inner forming fabric.

The wet web is then transferred from the inner forming fabric to a transfer fabric 40. In one embodiment, the transfer fabric can be traveling at a slower speed than the forming fabric in order to impart increased stretch into the web. This is commonly referred to as a "rush" transfer. Thus, during formation of the web, the web can undergo a wet rush transfer process in addition to the dry rush transfer process of the present invention. In fact, it is believed that the wet rush transfer can incorporate into the base sheet properties and characteristics that will lead to greater benefits when the base web is subjected to the dry rush transfer process later.

During wet rush transfer, the relative speed difference between the two fabrics can be from 0–80 percent, more specifically from about 5–45 percent. In one embodiment, for instance, the speed difference between the two fabrics can be from about 5 percent to about 15 percent. It is believed that, for some basesheets, especially those with a weak center layer, reducing rush transfer decreases the Z-direction peel strength of the base sheet (for a given geometric mean tensile strength and finished basis weight). For a given finished basis weight, pre-rush transfer basis weight increases with decreasing rush transfer, thus increasing the thickness of the weak center layer. Z-direction peel is believed to be lower for a thick weak center layer than for a thin weak center layer. Thus, lower rush transfer at the wet end can produce a web having a relatively weaker center layer which may provide various benefits during the dry rush transfer process of the present invention.

Transfer is preferably carried out with the assistance of a vacuum shoe 42 such that the forming fabric and the transfer fabric simultaneously converge and diverge at the leading edge of the vacuum slot. In one embodiment, the transfer of the web from the forming fabric to the transfer fabric can be carried out with a "fixed-gap" transfer or a "kiss" transfer in which the web is not substantially compressed between the two fabrics in order to preserve the caliper or bulk of the web and/or minimize fabric wear. "Kiss" transfer configurations may be more desirable in some applications.

The web is then transferred from the transfer fabric to the throughdrying fabric 44 with the aid of a vacuum transfer roll 46 or a vacuum transfer shoe, optionally again using a fixed gap transfer as previously described. The throughdrying fabric can be traveling at about the same speed or a different speed relative to the transfer fabric. If desired, the throughdrying fabric can be run at a slower speed to further enhance stretch. Transfer can be carried out with vacuum assistance to ensure deformation of the sheet to conform to the throughdrying fabric, thus yielding desired bulk and appearance if desired. Suitable throughdrying fabrics are described in U.S. Pat. No. 5,429,686 issued to Kai F. Chiu et al. and U.S. Pat. No. 5,672,248 to Wendt, et al. which are incorporated by reference to the extent that they are non-contradictory therewith.

The level of vacuum used for the web transfers can be from about 3 to about 15 inches of mercury (75 to about 380 millimeters of mercury), such as about 5 inches (125 millimeters) of mercury. The vacuum shoe (negative pressure) can be supplemented or replaced by the use of positive pressure from the opposite side of the web to blow the web onto the next fabric in addition to or as a replacement for sucking it onto the next fabric with vacuum. Also, a vacuum roll or rolls can be used to replace the vacuum shoe(s).

While supported by the throughdrying fabric, the web is dried to a consistency of greater than 50 percent such as about 94 percent or greater by the throughdryer 48 and thereafter transferred to a carrier fabric 50. The dried basesheet 2 is transported to the reel 54 using carrier fabric 50 and an optional carrier fabric 56. An optional pressurized turning roll 58 can be used to facilitate transfer of the web from carrier fabric 50 to fabric 56. Suitable carrier fabrics for this purpose are Albany 84M or 94M, obtained from Albany International located in Albany, N.Y., and Asten 959 or 937, obtained from Asten Johnson located in Appleton, Wis., all of which are relatively smooth fabrics having a fine pattern. Although not shown, reel calendaring or subsequent off-line calendaring can be used to improve the smoothness and softness of the basesheet.

In one embodiment, the paper web 52 is a textured web which has been dried in a three-dimensional state such that the hydrogen bonds joining fibers were substantially formed while the web was not in a flat, planar state. For instance, the web can be formed while the web is on a highly textured throughdrying fabric or other three-dimensional substrate. For example, the three-dimensional fabric can have from about 5 to about 300 impression knuckles per square inch (about 32 to about 1900 impressioned knuckles per square centimeter) which are raised at least about 0.005 inches (about 0.13 millimeters) above the plane of the fabric. Flat surfaces can also be used in the present invention. Processes for producing uncreped throughdried fabrics are, for instance, disclosed in U.S. Pat. No. 5,672,248 to Wendt, et al.; U.S. Pat. No. 5,656,132 to Farrington, et al.; U.S. Pat. No. 6,120,642 to Lindsay and Burazin; U.S. Pat. No. 6,096,169 to Hermans, et al.; U.S. Pat. No. 6,197,154 to Chen, et al.; and U.S. Pat. No. 6,143,135 to Hada, et al., all of which are herein incorporated by reference in their entireties to the extent that they are non-contradictory therewith.

Once the paper web is formed, the web may be immediately subjected to dry rush transfer. Alternatively, a bonding material may be applied to one or both sides of the web. The bonding material applied to the first side of the web can be the same or different than the bonding material applied to the second side of the web. Further, the bonding material can be applied to each side of the web according to the same pattern or according to a different pattern.

In general, any suitable bonding material can be used in the present invention. For example, any conventional creping adhesive can be used as the bonding material. Particular bonding materials that may be used in the present invention include latex compositions such as acrylates, vinyl acetates, vinyl chlorides, and methacrylates. Other bonding agents that may also be used include polyacrylamides, polyvinyl alcohols, and carboxymethyl cellulose. Further, non-latex adhesives, such as hot melt adhesives, may also be used. In one embodiment, the bonding material used in the process of the present invention comprises an ethylene vinyl acetate copolymer. In particular, the ethylene vinyl acetate copolymer can be cross-linked with N-methyl acrylamide groups using an acid catalyst. Suitable acid catalysts include ammonium chloride, citric acid, and maleic acid.

Various methods can be used to apply the bonding material to the base web. For instance, direct gravure printing using two separate gravure stations for each side of the web; offset gravure using duplex printing where both sides of the web are printed simultaneously; or station-to-station printing which includes consecutive printing on each side of the base web in one pass may be incorporated into the process. A combination of offset and direct gravure printing can also be used.

In addition to gravure printing, the bonding materials can also be applied to the web using flexographic printing, or inkjet printing. In still another embodiment, the bonding materials can be sprayed onto the web.

Figure 3:
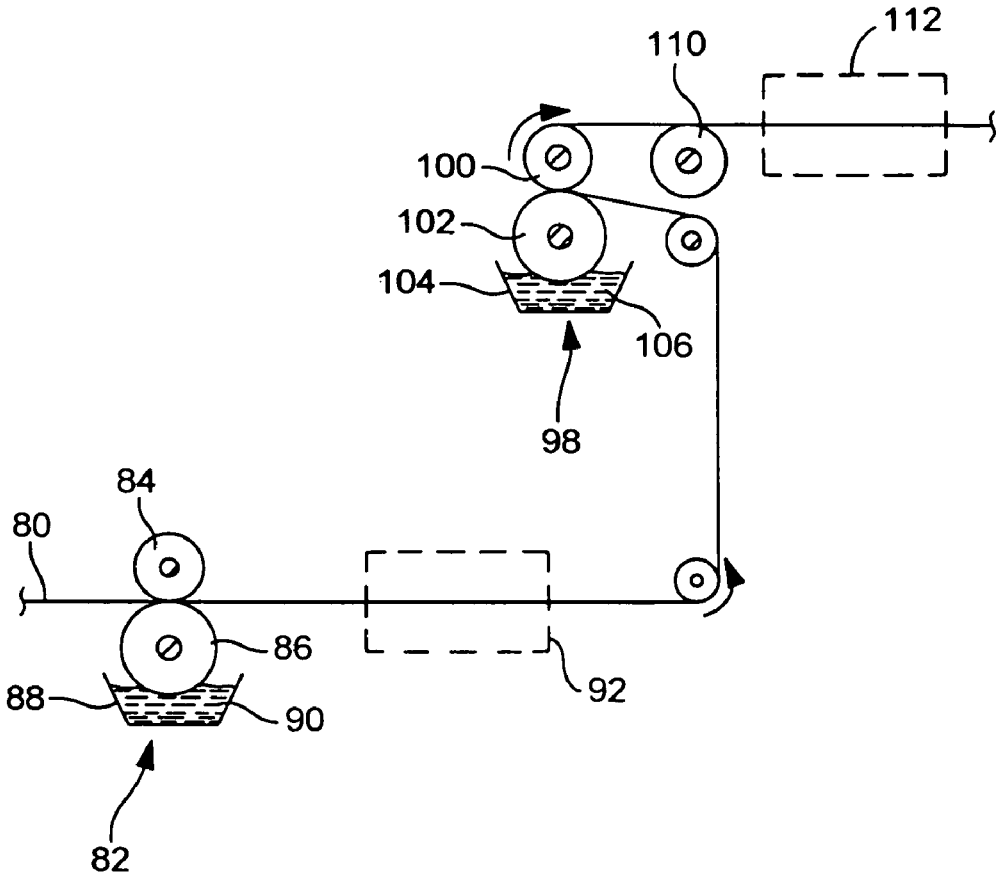
FIG. 3 is a schematic diagram of one embodiment of a process for applying bonding materials to each side of a paper web in accordance with one aspect of the present invention.

Referring to FIG. 3, one embodiment of a system that may be used to apply bonding materials to a base web in accordance with the present invention is illustrated. The embodiment shown in FIG. 3 can be an in-line or off-line process. As shown, a paper web 80 made according, for instance, to the process illustrated in FIG. 2 or according to a similar process, is passed through a first bonding agent application station generally 82. Station 82 includes a nip formed by a smooth rubber press roll 84 and a patterned rotogravure roll 86. Rotogravure roll 86 is in communication with a reservoir 88 containing a first bonding material 90. Rotogravure roll 86 applies the bonding material 90 to one side of web 80 in a preselected pattern.

After the first bonding material 90 is applied to the web, the bonding material can be dried if necessary. If it is desirable to dry the bonding material, for instance, the treated web can be fed to a drying station 92.

Drying station 92 can be any suitable drying device for drying the bonding material. For example, in one embodiment, drying station 92 can include an infrared heater. In an alternative embodiment, drying station 92 can be a convective oven. In still another embodiment, drying station 92 can be a heated roll that is contacted with the web. In still another embodiment of the present invention, the drying station 92 can include a microwave oven.

From the drying station 92, the web 80 can be advanced to a second bonding material application station generally 98.

Station 98 includes a transfer roll 100 in contact with a rotogravure roll 102, which is in communication with a reservoir 104 containing a second bonding material 106. Similar to station 82, second bonding material 106 is applied to the opposite side of web 80 in a preselected pattern.

Once the second bonding material is applied, the web 80 can then be passed through a second drying operation station 112, if necessary. Drying station 112 can be similar or different than drying station 92. Further, in another embodiment of the present invention, the system shown in FIG. 3 can include a single drying operation station 112 for simultaneously drying and/or curing the bonding material after application to the web.

The amount that the paper web is heated within the drying station 112 can depend upon the particular bonding materials used, the amount of bonding materials applied to the web, and the type of web used. In some applications, for instance, the paper web can be heated using a gas stream such as air at a temperature of about 510° F. (about 270° C.) in order to cure the bonding materials. When using low cure temperature bonding materials, on the other hand, the gas can be at a temperature lower than about 270° F. (about 130° C.) and particularly lower than about 250° F. (about 120° C.).

The bonding materials are applied to the base web as described above in a preselected pattern. In one embodiment, for instance, the bonding materials can be applied to the web in a reticular pattern, such that the pattern is interconnected forming a net-like design on the surface.

In an alternative embodiment, however, the bonding materials are applied to the web in a pattern that represents a succession of discrete shapes. Applying the bonding material in discrete shapes, such as dots, provides sufficient strength to the web without covering a substantial portion of the surface area of the web.

According to the present invention, the bonding materials are applied to each side of the paper web so as to cover from about 15% to about 75% of the surface area of the web. For instance, in many applications, the bonding material can cover from about 20% to about 60% of the surface area of each side of the web. The total amount of bonding material applied to each side of the web can be in the range of from about 4% to about 10% by weight, based upon the total weight of the web.

At the above amounts, the bonding materials can penetrate the paper web from about 10% to about 70% of the total thickness of the web. In most applications, the bonding materials should at least penetrate from about 10% to about 15% of the thickness of the web.

Figure 5:
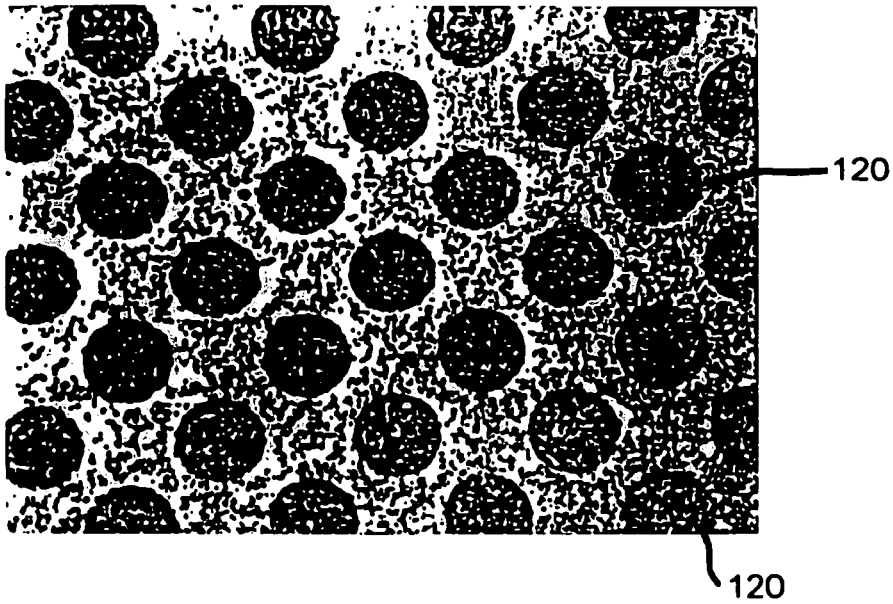
FIG. 5 is a plan view of one embodiment of a pattern that is used to apply bonding materials to paper webs made in accordance with one aspect of the present invention.

Referring to FIG. 5, one embodiment of a pattern that can be used for applying a bonding material to a paper web in accordance with the present invention is shown. As illustrated, the pattern shown in FIG. 5 represents a succession of discrete dots 20. In one embodiment, for instance, the dots can be spaced so that there are approximately from about 25 to about 35 dots per inch (about 9.8 to about 14 dots per centimeter) in the machine direction or the cross-machine direction. The dots can have a diameter, for example, of from about 0.01 inches to about 0.03 inches (about 0.025 centimeters to about 0.076 centimeters). In one particular embodiment, the dots can have a diameter of about 0.02 inches (about 0.051 centimeters) and can be present in the pattern so that about 28 dots per inch (about 11 dots per centimeter) extend in either the machine direction or the cross-machine direction. In this embodiment, the dots can cover from about 20% to about 30% of the surface area of one side of the paper web and, more particularly, can cover about 25% of the surface area of the web.

Figure 7:
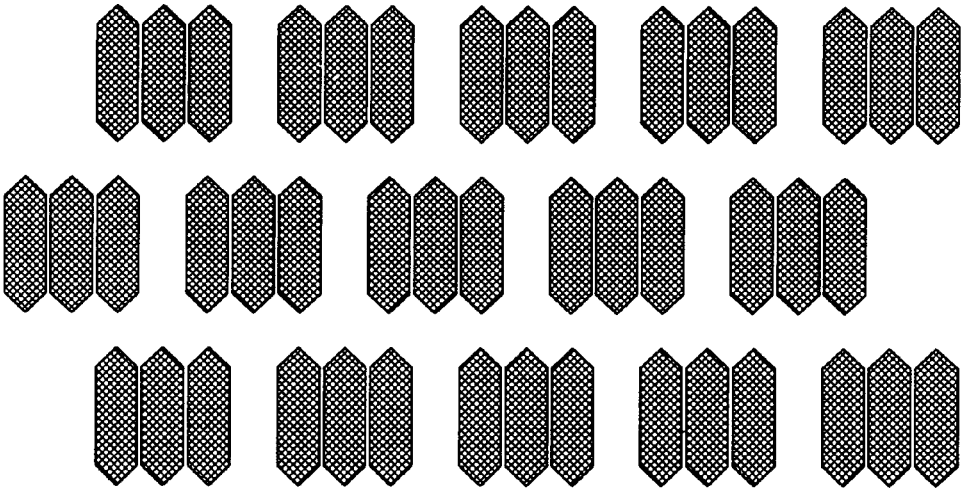
FIG. 7 is a plan view of another alternative embodiment of a pattern that is used to apply bonding materials to paper webs in accordance with the present invention.

Besides dots, various other discrete shapes can also be used. For example, as shown in FIG. 7, a pattern is illustrated in which the pattern is made up of discrete shapes that are each comprised of three elongated hexagons. In one embodiment, the hexagons can be about 0.02 inches (about 0.051 centimeters) long and can have a width of about 0.006 inches (about 0.015 centimeters). Approximately 35 to 40 hexagons per inch (approximately 14 to 16 hexagons per centimeter) can be spaced in the machine direction and the cross-machine direction. When using hexagons as shown in FIG. 7, the pattern can cover from about 40% to about 60% of the surface area of one side of the web, and more particularly can cover about 50% of the surface area of the web.

Figure 6:
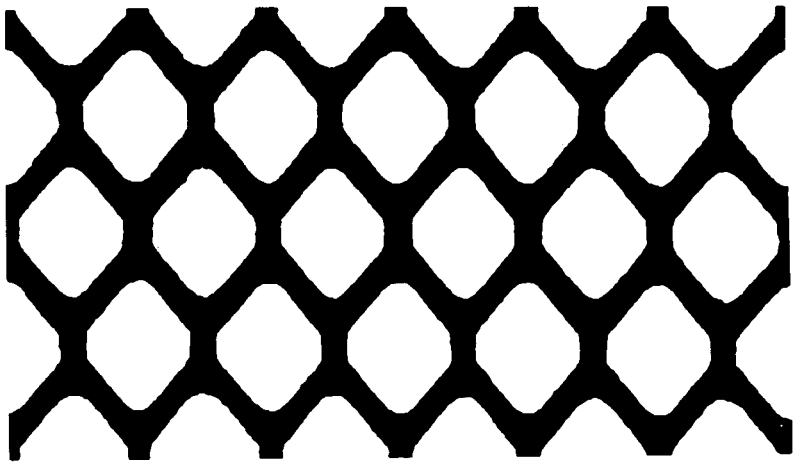
FIG. 6 is another embodiment of a pattern that is used to apply bonding materials to paper webs in accordance with one aspect of the present invention.

Referring to FIG. 6, another embodiment of a pattern for applying a bonding material to a paper web is shown. In this embodiment, the pattern is a reticulated grid. More specifically, the reticulated pattern is in the shape of diamonds. When used, a reticulated pattern may provide more strength to the web in comparison to patterns that are made up on a succession of discrete shapes.

In one particular embodiment of the present invention, a first bonding material is applied to a paper web according to the pattern shown in FIG. 5. A second bonding material, on the other hand, is applied to a second side of the paper web according to the pattern illustrated in FIG. 7. The second bonding material is applied to a greater amount of the surface area than the first bonding material. For example, the first bonding material can be applied according to the pattern shown in FIG. 5 and can cover approximately 25% of the surface area of the first side of the web. The second bonding material, however, is applied according to the pattern shown in FIG. 7 and covers approximately 50% of the surface area of the second side of the web.

After the bonding materials are optionally applied to one or both sides of the web, the treated web is then subjected to a dry rush transfer process in accordance with the present invention. Prior to rush transfer, optionally, the bonding materials may be dried if necessary. Further, although optional, the bonding materials can also be cured. It should also be understood that the dry rush transfer process can be carried out on a web not treated with a bonding material which has a relatively low moisture content.

Figure 4:
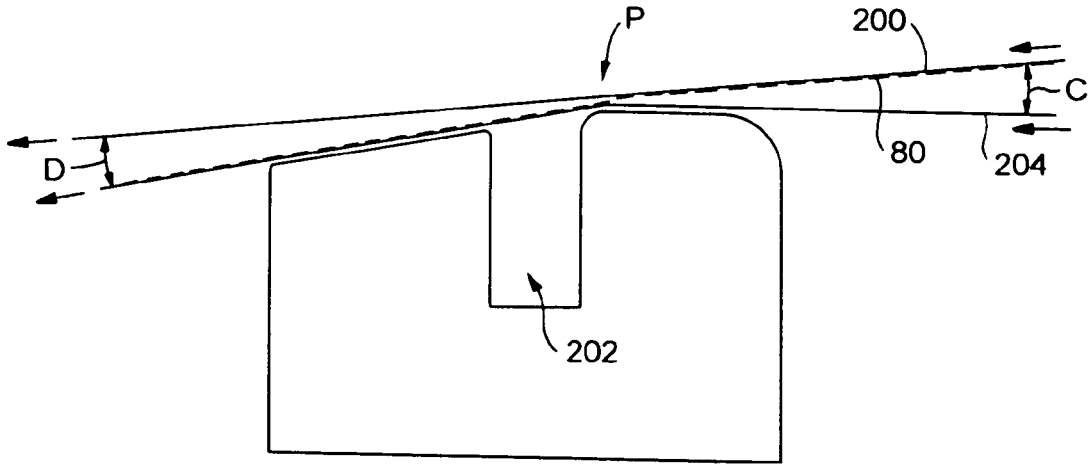
FIG. 4 is a schematic diagram of one embodiment of a dry rush transfer process to be performed on a paper web after the paper web has optionally been treated with a bonding material.

Referring to FIG. 4, one embodiment of a dry rush transfer process is shown. The process shown in FIG. 4 can be directly coupled to the optional process shown in FIG. 3. In an alternative embodiment, however, a web can be treated with a bonding material and wound into a roll. The web can then be unwound and fed into the process as illustrated in FIG. 4.

As illustrated, the base web 80 is carried on a first moving conveyor or fabric 200 toward the transfer point traveling in the direction shown by the arrows. If desired, an optional first vacuum box (not shown) can be used to hold the base web onto the moving conveyor 200 prior to rush transfer. The first vacuum box can apply a low suction force to the sheet. For example, the first vacuum box can, in one embodiment, exert less than about ten inches Hg (about 250 millimeters Hg) vacuum.

From the first moving conveyor 200, the paper web 80 is transferred to a second moving conveyor 204. In this embodiment, the second moving conveyor 204 is positioned below the first moving conveyor 200. In order to exert shear forces on the web 80, the second moving conveyor 204 travels at a slower speed than the first moving conveyor 200. The angle of convergence between the two incoming conveyors is designated as "C". The angle of divergence between the two conveyors is designated as "D". Further, the two conveyors simultaneously converge and diverge at the transfer point "P" which corresponds to the leading edge of a second vacuum box 202.

In order to facilitate transfer between the first moving conveyor 200 and the second moving conveyor 204, the second vacuum box 202 is positioned against the second moving conveyor at the point of transfer. The second vacuum box can, in one embodiment, exert a strong vacuum transfer force on the base web 80. For instance, the second vacuum box 202 can exert a vacuum transfer force of from about 2 inches to about 20 inches Hg (about 51 millimeters to about 510 millimeters Hg) vacuum. When the conveyors reach point of transfer, it is not necessary for both fabrics to be in contact over the entire length of the second vacuum box 202. Further, minimizing the time the fabrics are in contact is beneficial in that it reduces or eliminates the presence of macrofolds in the resulting base web 80. A particularly preferred geometry places the web and the two fabrics in point contact at the transfer point "P".

In general, in order to effect the most changes on the base web 80, the speed differential between the first moving conveyor 200 and the second moving conveyor 204 is as great as possible for a particular configuration. For example, the speed differential between the moving conveyors should be at least 5%, particularly at least 10% and more particularly the second moving conveyor should move at least 15% slower than the first moving conveyor. For example, in one embodiment, the second moving conveyor can be moving at a speed that is about 20% slower than the first moving conveyor, particularly at least 25% slower and, in one embodiment, at least 30% slower. In general, the second moving conveyor can be moving at a speed that is from about 10% to about 80% slower than the first moving conveyor, and particularly from about 10% to about 50% slower. For many applications, increasing the speed differential between the two moving conveyors creates greater shear that acts on the web.

In one embodiment, the base web may be subjected to successive rush transfer operations.

As illustrated by FIG. 4, the angle of convergence "C" and angle of divergence "D" can be made small which may reduce fabric wear. In particular, the angle of convergence "C" and the angle of divergence "D" can be less than 5°.

Once the base web 80 is subjected to the dry rush transfer process, the web 80 can be further processed as desired. For example, the web can be immediately fed into a packaging operation or can be wound into a roll and subjected to further converting operations as desired.

Through the dry rush transfer process of the present invention, various advantages and benefits can be obtained. For instance, the dry rush transfer process decreases the stiffness of the web. For example, the machine direction slope of the web can decrease by at least 5%, particularly at least 10%, and more particularly at least 15%.

In addition to decreasing the stiffness of the web, various other benefits and advantages can be obtained. For example, in various embodiments it is believed that the process can be used to increase sheet caliper, increase machine direction stretch, increase cross machine direction stretch and to and otherwise improve the softness of the web.

Figure 8:
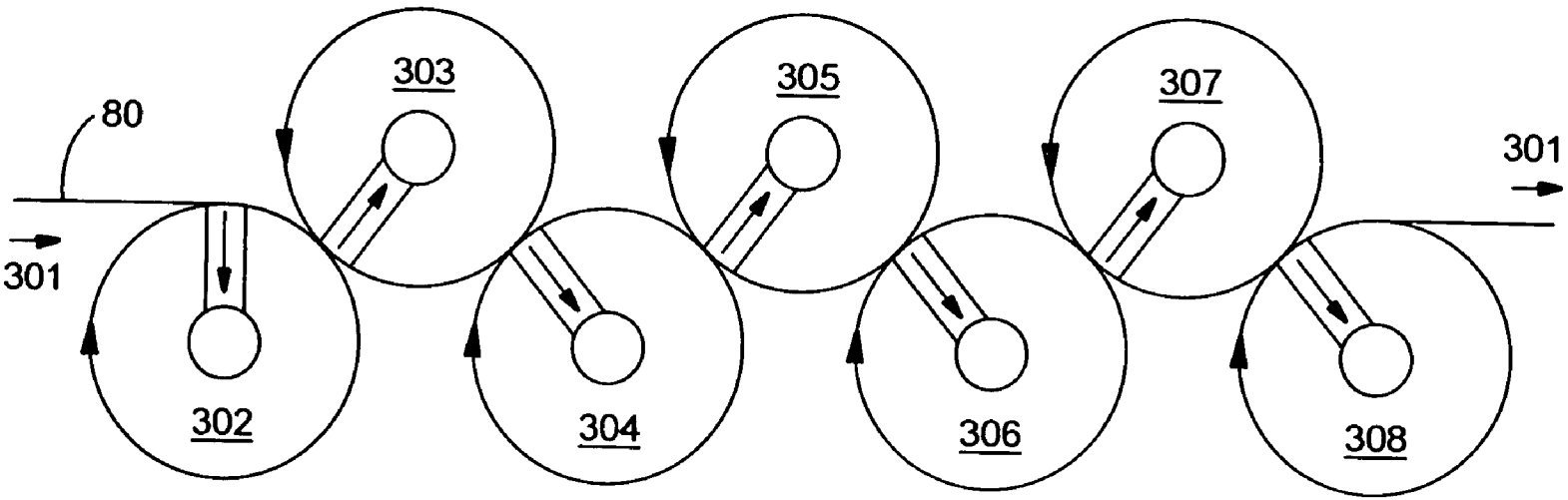
FIG. 8 is a schematic diagram of one embodiment of a dry rush transfer process to be performed on a paper web after the paper web has optionally been treated with a bonding material.

Referring to FIG. 8, another embodiment of a dry rush transfer process is shown. In this embodiment, instead of moving conveyors, rotating rolls are used to carry out the rush transfer process. As illustrated, the paper web 80 is transported in an open draw to the first vacuum transfer roll 302. An optional first vacuum box may be used to hold the paper web 80 to the surface of the first vacuum transfer roll 302 prior to rush transfer. The first vacuum transfer roll 302 can apply a low suction force to the sheet. For example, the first vacuum transfer roll can, in one embodiment, exert less than about ten inches Hg (250 mm Hg) vacuum.

From the first vacuum transfer roll 302, the paper web 80 is transferred to a second vacuum transfer roll 303. In this embodiment, the second vacuum transfer roll 303 is positioned adjacent first vacuum transfer roll 302. In order to exert shear forces on the web 80, the second vacuum transfer roll 303 travels at a slower speed than the first vacuum transfer roll 302. To facilitate transfer between the first vacuum transfer roll 302 and the second vacuum transfer roll 303, the leading edge of the vacuum box of second vacuum transfer roll 303 is positioned at the point of closest proximity between the first vacuum transfer roll 302 and the second vacuum transfer roll 303.

In one embodiment, there is a small gap at the point of closest proximity between the first vacuum transfer roll 302 and the second vacuum transfer roll 303. This gap is preferably less than about 25 millimeters, more preferably less than about 5 millimeters, even more preferably less than about 1 millimeter, even more preferably less than about 0.5 millimeters. In another embodiment, the vacuum transfer roll 302, the second vacuum transfer roll 303, and the paper web 80 are in contact at the leading edge of the vacuum box of the second vacuum transfer roll 303.

Optionally, the surfaces of transfer rolls 302, 303, 304, 305, 306, 307, and 308 may be textured to provide local straining during transfer to further soften the sheet. Each of the vacuum transfers roll 302 through 308 may have similar or different textures.

The vacuum box of the second vacuum transfer roll 303 can, in one embodiment, exert a strong vacuum transfer force on the base web 80. For instance, the second vacuum box 202 can exert a vacuum transfer force of from about two inches to about 20 inches Hg (about 51 millimeters Hg to 510 millimeters Hg) vacuum.

In general, in order to effect the most changes on the base web 80, the speed differential between the first vacuum transfer roll 302 and the second vacuum transfer roll 303 is as great as possible for a particular configuration. For example, the speed differential between the moving surfaces should be at least 5%, particularly at least 10% and more particularly the second moving surface should move at least 15% slower than the first moving surface. For example, in one embodiment, the second moving surface can be moving at a speed that is about 20% slower than the first moving surface, particularly at least 25% slower and, in one embodiment, at least 30% slower.

For many applications, increasing the speed differential between the two rotating rolls creates greater shear that acts on the web. In an embodiment of the invention, vacuum transfer rolls 304, 305, 306, 307 and 308 are used sequentially to rush transfer the sheet with 302 faster than 303, 303 faster than 304, 304 faster than 305, 305 faster than 306, 306 faster than 307, and 307 faster than 308. In this manner, cumulative rush transfer occurs with a speed differential between the first transfer roll 302 and the last transfer roll 308 to be greater than about, for instance, 50%, such as up to 80% or even greater.

In an embodiment of the invention, one or more of vacuum transfer rolls 302, 303, 304, 305, 306, 307, and/or 308 may be used to drag transfer the sheet before, between, and/or after a dry rush transfer step or steps, for example to increase web tension; for instance, roll 305 could be run faster than roll 304.

In the embodiment illustrated in FIG. 8, seven vacuum transfer rolls are illustrated. It should be understood, however, that the system of the present invention can include a greater or lesser number of transfer rolls as desired.

According to the process of the current invention, numerous and different paper products can be formed. In general, the paper products are single-ply wiper products. The products can be, for instance, facial tissues, bath tissues, paper towels, napkins, industrial wipers, and the like. As stated above, the basis weight can range anywhere from about 15 gsm to about 110 gsm. In one particular embodiment, the present invention is directed to the production of a paper towel product having a basis weight of from about 35 gsm to about 70 gsm.

The present invention may be better understood with reference to the following examples.

EXAMPLE 1

To illustrate the properties of a wiping product made in accordance with the present invention, an uncreped through-air dried (UCTAD) base web was treated with a bonding material according to the teachings of the present invention and the web was then subjected to a dry rush transfer process. The UCTAD base web was formed in a process similar to the method shown in FIG. 2. In this particular example, the base web was made from a stratified fiber furnish containing a center layer of fibers (50% by weight) positioned between two outer layers of fibers (25% by weight each). All three layers of the UCTAD base web contained 100% northern softwood Kraft pulp and 3.4 kg/MT of PROSOFT TQ1003 debonder obtained from the Hercules Corporation (Wilmington, Del.).

During formation of the UCTAD base sheet, the sheet was subjected to a wet rush transfer process. Specifically, a first sample, referred to as Sample No. 1 below, was produced with 15% rush transfer and a second sample indicated as Sample No. 2 below was produced with 25% rush transfer.

Each side of the formed webs were then treated with a bonding material similar to the process shown in FIG. 3. The bonding material used was a copolymer of an ethylene vinyl acetate, specifically the bonding material was AIRFLEX EN1165 sold by Air Products Polyers, L.P. (Allentown, Pa.). The first side of the web was printed with the pattern shown in FIG. 5; the second side was printed with the pattern shown in FIG. 7. Latex add-on was between 6% to 8% of total weight. Cure temperature was 500° F. (260° C.).

After the bonding material was applied to each side of the base web and dried, the web was then subjected to a dry rush transfer process similar to the process illustrated in FIG. 4. In this example, both samples were subjected to 14.3% dry rush transfer. In other words, the first moving conveyor was moving at a speed 14.3% faster than the second moving conveyor.

The samples were then subjected to standardized tests for dry tensile strength, stretch and slope. The tensile strength, the percent stretch and the slope of samples were determined in the machine direction (MD) and in the cross machine direction (CD). The results are expressed in grams to break and percent stretch before breakage. Higher numbers indicate a stronger, more stretchable fabric. Slope is a measure of the stiffness of the base web and is also measured in grams per three inches (76 mm). Smaller slope numbers indicate a less stiff sheet.

Tensile strength was measured using a tensile tester having a 3-inch (76 mm) jaw width (sample width), a jaw span of four inches (102 mm) (gauge length), and a cross-head speed of 10 inches (254 mm) per minute after maintaining samples under TAPPI conditions before testing. As mentioned above, tensile strength is the amount of force needed to break the sample. Percent stretch is the peak stretch of the sample before breakage.

The slope of the samples, which is also referred to as extensional modulus, is a measure of the slope of a stress-strain curve of a web taken during a tensile test and is expressed in units of grams force per 3 inches (76 mm). In particular, the slope is taken as the least squares fit of the data between stress values of 70 and 157 grams of force per 3 inches (76 mm).

Tensile strength tests and elongation tests were performed on a SYNERGY tester available from MTS Systems, Corp. (Eden Prairie, Minn.). Results are reported in grams or in grams per width of sample.

The results of the tests are shown below:

TABLE 1

| | Sample No. 1 | | Sample No. 2 | |
|---|---|---|---|---|
| | Base Web | After Dry Rush Transfer | Base Web | After Dry Rush Transfer |
| MD Tensile (g/76 mm) | 2500 | 2380 | 2340 | 2330 |
| MD Stretch (%) | 8.5 | 7.9 | 12.6 | 11.6 |
| MD Slope (g/76 mm) | 35100 | 32600 | 24300 | 18800 |
| CD Tensile (g/76 mm) | 1540 | 1510 | 1520 | 1460 |
| CD Stretch (%) | 10.3 | 10.7 | 12.2 | 12.2 |
| CD Slope (g/76 mm) | 12700 | 12900 | 11200 | 10600 |

As shown above, the process of the present invention significantly improved the stiffness of the base web. In particular, the machine direction slope of the web decreased by 7% in Sample No. 1 and by 23% in Sample No. 2. Further, these results were obtained at only 14.3% dry rush transfer.

EXAMPLE 2

An UCTAD base sheet similar to the one described in Example No. 1 was formed. During formation, the base sheet was subjected to 15% wet rush transfer.

After being formed, the base sheet was treated with a bonding material on both sides similar to the samples in Example 1 and then subjected to a dry rush transfer process. During the dry rush transfer process, a first sample of the base sheet was run through an upstream conveyor moving at a speed 11.1% faster than the downstream moving conveyor.

A second sample of the basesheet was also run with an upstream conveyor moving at a speed 14.3% faster than the downstream moving conveyor. The following results were obtained:

TABLE 2

| | Sample No. 3 | | |
|---|---|---|---|
| | Base Web | After 11.1% Dry Rush Transfer | After 14.3% Dry Rush Transfer |
| MD Tensile (g/76 mm) | 2410 | 2410 | 2400 |
| MD Stretch (%) | 7.8 | 7.0 | 7.9 |
| MD Slope (g/76 mm) | 36800 | 28900 | 32000 |
| CD Tensile (g/76 mm) | 1490 | 1450 | 1390 |
| CD Stretch (%) | 10.2 | 11.3 | 10.5 |
| CD Slope (g/76 mm) | 13400 | 11100 | 11800 |

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A process for forming a wiping product comprising:

providing a base web having a consistency greater than 50%, the base web including a first side and a second and opposite side;

applying a bonding material to at least one side of the base web; and thereafter conveying the base web from a first moving surface to a second moving surface, the second moving surface moving slower than the first moving surface causing the base web to shear and decrease in stiffness such that the base web maintains substantially the same tensile strength in the machine direction after conveyance, and such that the base web maintains substantially the same stretch in the cross direction after conveyance.

2. A process as defined in claim 1, wherein the base web comprises pulp fibers.

3. A process as defined in claim 1, wherein the base web is dried to a consistency of at least about 90% prior to conveyance.

4. A process as defined in claim 1, wherein the base web is noncompressively dried prior to conveyance.

5. A process as defined in claim 4, wherein the non compressive drying comprises through air drying.

6. A process as defined in claim 1, wherein the second moving surface is moving at a speed that is at least 10 percent slower than the first moving surface.

7. A process as defined in claim 1, wherein the second moving surface is moving at a speed that is at least 15 percent slower than the first moving surface.

8. A process as defined in claim 1, wherein the second moving surface is moving at a speed that is at least 20 percent slower than the first moving surface.

9. A process as defined in claim 1, wherein the second moving surface is moving at a speed that is at least 25 percent slower than the first moving surface.

10. A process as defined in claim 2, wherein the base web is uncreped prior to conveyance.

11. A process as defined in claim 1, wherein the base web has a basis weight of from about 15 gsm to about 110 gsm.

12. A process as defined in claim 1, wherein the base web is made from a stratified fiber furnish having a middle layer positioned in between two outer layers, the middle layer having a tensile strength less than each of the outer layers.

13. A process as defined in claim 12, wherein the middle layer has been treated with a debonder in an amount greater than the outer layers.

14. A process as defined in claim 12, wherein the middle layer comprises high yield fibers, synthetic fibers, or mixtures thereof.

15. A process as defined in claim 1, wherein the bonding material is applied to the base web in a total amount of from about 4 percent to about 10 percent by weight of the base web.

16. A process as defined in claim 1, wherein the bonding material is applied to the first side of the base web in a pattern that covers from about 20 percent to about 60 percent of the surface area of the first side and wherein the bonding material is applied to the second side of the paper web also in a pattern that covers from about 20 percent to about 60 percent of the surface area of the second side.

17. A process as defined in claim 1, wherein the bonding material is applied to the first side of the base web according to a first pattern and is applied to the second side of the base web according to a second pattern, the first pattern being different than the second pattern.

18. A process as defined in claim 17, wherein at least the first pattern comprises a reticular pattern.

19. A process as defined in claim 17, where at least the first pattern comprises a pattern of discrete shapes.

20. A process as defined in claim 1, wherein the bonding material comprises an ethylene vinyl acetate copolymer.

21. A process as defined in claim 1, wherein the bonding material comprises an acrylate, a vinyl chloride, a polyacrylamide, a polyvinyl alcohol, a carboxymethyl cellulose, or a hot melt adhesive.

22. A process as defined in claim 1, wherein the bonding material is printed onto the base web.

23. A process as defined in claim 1, wherein the first moving surface and the second moving surface comprise conveyors.

24. A process as defined in claim 1, wherein the first moving surface and the second moving surface comprise rotating rolls.

25. A process as defined in claim 1, wherein the consistency of the base web is greater than 70%.

26. A process as defined in claim 1, wherein the base web is substantially non-compressed.

27. A process as defined in claim 1, wherein the step of conveying the base web is performed such that the base web maintains substantially the same stretch in the machine direction after conveyance.

28. A process for forming a wiping product comprising:

providing an uncreped and through-air dried base web comprising pulp fibers, the base web including a first side and a second and opposite side, the base web having a basis weight of from about 15 gsm to about 110 gsm;

applying a bonding material to the first side of the base web and to the second side of the base web, the bonding material being applied to the base web in an amount from about 4 percent to about 10 percent by weight of the web, the bonding material being applied to each side of the web such that the bonding material covers from about 20 percent to about 80 percent of the surface area of each side of the web;

conveying the base web treated with the bonding material from a first moving conveyor to a second moving conveyor, the second moving conveyor moving slower than the first moving conveyor causing the base web to shear and decrease in stiffness, the second moving conveyor moving at a speed that is at least 15 percent slower than the first moving conveyor.

29. A process as defined in claim 28, wherein the second moving conveyor is moving at a speed that is at least 20 percent slower than the first moving conveyor.

30. A process as defined in claim 28, wherein the second moving conveyor is moving at a speed that is at least 25 percent slower than the first moving conveyor.

31. A process as defined in claim 28, further comprising the step of subjecting the base web to a rush transfer process during formation of the base web prior to drying the base web, the rush transfer process comprising conveying the base web from a first forming fabric to a second forming fabric, the second forming fabric moving slower than the first forming fabric.

32. A process as defined in claim 31, wherein the second forming fabric is moving at a speed that is no more than about 20 percent slower than the first forming fabric.

33. A process for forming a wiping product comprising:

providing a base web having a consistency greater than 50%, the base web including a first side and a second opposite side;

applying a bonding material to at least one side of the base web; and thereafter conveying the base web from a first moving surface to a second moving surface, the second moving surface moving slower than the first moving surface causing the base web to shear and decrease in stiffness such that the base web maintains substantially the same tensile strength in the machine direction after conveyance, and substantially the same stretch in the machine direction after conveyance.

34. A process as defined in claim 33, wherein the step of conveying the base web is performed such that the base web maintains substantially the same stretch in the cross direction after conveyance.

* * * * *